US008607705B2

(12) United States Patent
Golden et al.

(10) Patent No.: US 8,607,705 B2
(45) Date of Patent: Dec. 17, 2013

(54) LOW SHOCK ROCKET BODY SEPARATION

(75) Inventors: Peter J. Golden, Seattle, WA (US); Jonathan D. Beaudoin, Bothell, WA (US); Randel L. Hoskins, Woodinville, WA (US); Keith Krasnowski, Lynnwood, WA (US); Anthony G. Desimone, Everett, WA (US)

(73) Assignee: Systima Technologies Inc., Bothell, WA (US)

( * ) Notice: Subject to any disclaimer, the term of this patent is extended or adjusted under 35 U.S.C. 154(b) by 359 days.

(21) Appl. No.: 12/961,323

(22) Filed: Dec. 6, 2010

(65) Prior Publication Data

US 2012/0137917 A1 Jun. 7, 2012

(51) Int. Cl.
*F42B 15/10* (2006.01)

(52) U.S. Cl.
USPC ..... 102/377; 102/378; 89/1.14

(58) Field of Classification Search
USPC ..... 102/377, 378; 89/1.14
See application file for complete search history.

(56) References Cited

U.S. PATENT DOCUMENTS

| | | | | |
|---|---|---|---|---|
| 2,996,316 | A | 8/1961 | Terhune | |
| 3,119,302 | A * | 1/1964 | Barr | 89/1.14 |
| 3,139,031 | A * | 6/1964 | Schroter et al. | 52/98 |
| 3,311,056 | A * | 3/1967 | Noddin | 102/275.8 |
| 3,319,520 | A * | 5/1967 | Stefano et al. | 89/1.14 |
| 3,453,960 | A * | 7/1969 | Qualls | 102/378 |
| 3,486,410 | A * | 12/1969 | Lake et al. | 89/1.14 |
| 3,501,112 | A * | 3/1970 | Bamford | 244/158.1 |
| 3,633,456 | A * | 1/1972 | Carr et al. | 89/1.14 |
| 3,698,281 | A * | 10/1972 | Brandt et al. | 89/1.14 |
| 3,903,803 | A | 9/1975 | Losey | |
| 3,971,290 | A | 7/1976 | Blain | |
| 4,106,875 | A * | 8/1978 | Jewett | 403/2 |
| 4,137,848 | A * | 2/1979 | Cunha | 102/378 |
| 4,648,227 | A * | 3/1987 | Reusch | 52/419 |
| 4,685,376 | A * | 8/1987 | Noel et al. | 89/1.14 |
| 4,688,486 | A * | 8/1987 | Hall et al. | 102/489 |
| 4,717,096 | A * | 1/1988 | Labarre et al. | 244/137.2 |
| 4,860,698 | A * | 8/1989 | Patrichi et al. | 123/24 R |
| 4,879,941 | A * | 11/1989 | Repe et al. | 89/1.14 |
| 5,109,749 | A * | 5/1992 | Olcer | 89/1.14 |
| 5,129,306 | A * | 7/1992 | Fauvel | 89/1.14 |
| 5,226,617 | A | 7/1993 | Panin | |
| 5,277,460 | A | 1/1994 | Grainge | |
| 5,318,255 | A | 6/1994 | Facciano | |
| 5,372,071 | A * | 12/1994 | Richards et al. | 102/378 |
| 5,535,502 | A * | 7/1996 | Harris | 29/527.1 |
| 5,585,596 | A * | 12/1996 | Richards et al. | 102/378 |

(Continued)

OTHER PUBLICATIONS

Gluckman, Aerospace Vehicle Separation and Mechanisms Selection, Design, and Use Considerations, Fifth Aerospace Mechanisms Symposium, Jun. 1970, 7 pages.

(Continued)

*Primary Examiner* — Michelle Clement
(74) *Attorney, Agent, or Firm* — Jensen & Puntigam, PS

(57) ABSTRACT

The present disclosure generally relates a high strength, low weight, and low shock rocket body separating joint for the purpose of joining rocket bodies, and method of assembly thereof. The solution combines a radax joint, joined by fasteners, with a flattened bladder and inflation system coupled thereto. Upon activation of the inflation system, the bladder is pressurized and exerts a separating force between the members of the radax joint, overcoming the load carrying capability of the fasteners and breaking apart the radax joint.

21 Claims, 9 Drawing Sheets

(56) References Cited

U.S. PATENT DOCUMENTS

| | | | | |
|---|---|---|---|---|
| 5,735,626 | A * | 4/1998 | Khatiblou et al. | 403/16 |
| 5,898,123 | A * | 4/1999 | Fritz et al. | 102/378 |
| 5,983,802 | A * | 11/1999 | Blain et al. | 102/378 |
| 5,992,328 | A * | 11/1999 | Blain et al. | 102/378 |
| 6,125,762 | A * | 10/2000 | Fritz et al. | 102/378 |
| 6,138,951 | A | 10/2000 | Budris | |
| 6,286,430 | B1 * | 9/2001 | Salort | 102/378 |
| 6,298,786 | B1 * | 10/2001 | Grosskrueger et al. | 102/378 |
| 6,371,684 | B2 | 4/2002 | Giesenberg | |
| 6,390,416 | B2 * | 5/2002 | Holemans | 244/173.3 |
| 6,901,836 | B1 * | 6/2005 | Valembois et al. | 89/1.14 |
| 7,127,994 | B2 * | 10/2006 | Cleveland | 102/378 |
| 7,188,558 | B2 * | 3/2007 | Brede et al. | 89/1.14 |
| 7,261,038 | B2 * | 8/2007 | Cleveland | 102/378 |
| 7,367,738 | B2 * | 5/2008 | Cleveland | 403/31 |
| 7,513,184 | B2 * | 4/2009 | Kister | 89/1.57 |
| 8,141,491 | B1 * | 3/2012 | Travis | 102/378 |
| 8,230,770 | B1 * | 7/2012 | Renn | 89/1.14 |
| 2003/0196544 | A1 * | 10/2003 | Comtesse | 89/1.14 |

OTHER PUBLICATIONS

Goldstein, Exploding Into Space: Explosive Ordnance for Space Systems, Crosslink Magazine, Fall 2006, 5 pages.

* cited by examiner

LOW SHOCK ROCKET BODY SEPARATION

STATEMENT OF GOVERNMENT SUPPORT

The invention was made with government support under contract W9113M-07-C-0047. The government has certain rights in the invention.

BACKGROUND

Predominant rocket body separation systems used by the aerospace industry include stage separation systems using Linear Shape Charges (LSCs) and other variations that use explosives. The explosives create a hazardous work environment, are expensive, make rocket assembly more logistically challenging, generate debris, and generate a large amount of source shock detrimental to electronic systems. The shock energy produced by explosives-based rocket body separation systems transmits through the rocket structure and into sensitive payloads that are susceptible to damage from high shock loads.

SUMMARY

A low shock rocket body separating joint for the purpose of joining and separating rocket bodies, and method of assembly thereof is disclosed. The proposed solution combines the use of a radax joint, joined by fasteners, with a flattened bladder and inflation system coupled thereto. Upon activation of the inflation system, the bladder is pressurized and exerts a separating force between the members of the radax joint, overcoming the load carrying capability of the fasteners and breaking apart the radax joint. Advantages of the disclosed technology include increased strength, reduced weight, reduced induced shock during rocket body separation, and reduced assembly hazards and logistics.

BRIEF DESCRIPTION OF THE DRAWINGS

The accompanying drawings depict example features and embodiments in accordance with this disclosure, and are not limiting of its scope.

DETAILED DESCRIPTION

Figure 1:
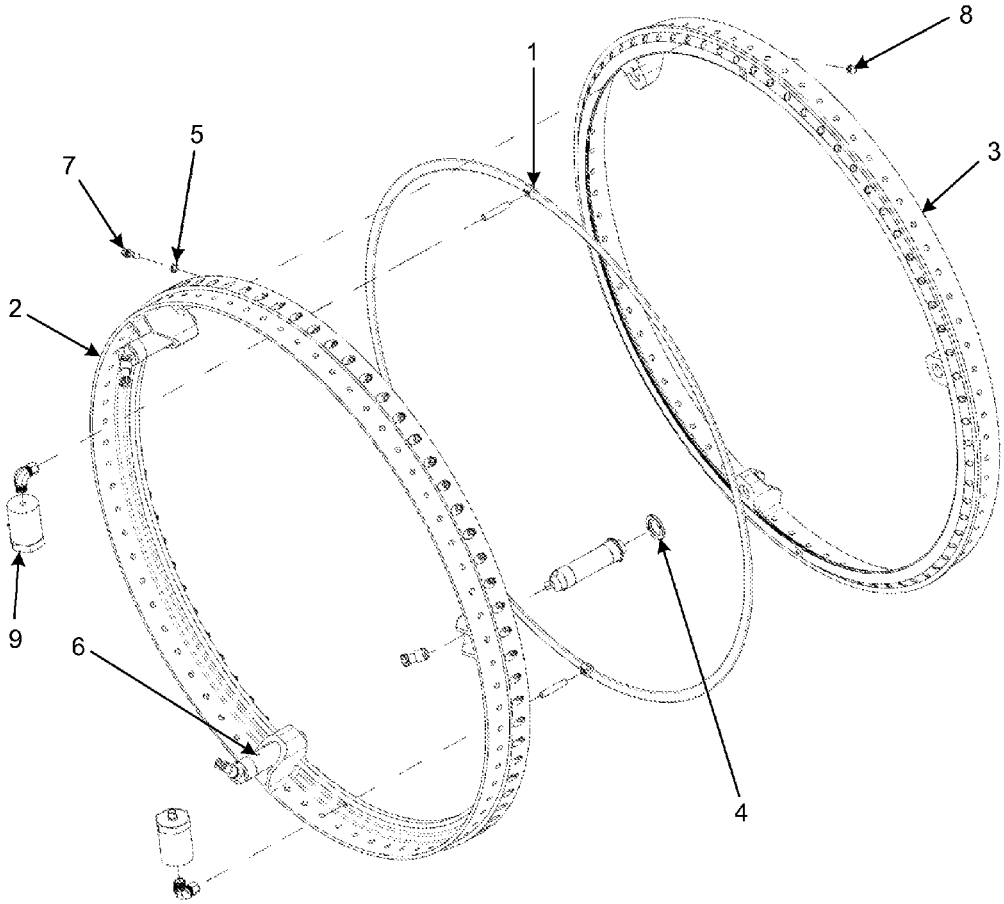
FIG. 1 is a diagram illustrating an example rocket body separation system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made part of this disclosure.

FIG. 1 is a diagram illustrating an example rocket body separation system. The rocket body separation system may comprise a radax-type joint including a first radax member 2 and a second radax member 3, each member coupleable to a rocket body such as a booster stage, payload, or other rocket body, and each member coupleable to the other member. Members of the radax joint may be coupleable to one another using fasteners such as 7, e.g., frangible bolts, washers such as 5, and threaded inserts such as 8. The fastener quantity and spacing may be adjusted to accommodate the load carrying capability of the joint.

The radax joint may be round, as illustrated in FIG. 1, or may be any other shape. In general, the shape of the radax joint will conform to the shape of the rocket bodies joined by the joint. The illustrated configuration provides added benefit in that separation systems don't have to take on a cylindrical shape. The apparatus, systems and methods disclosed herein are applicable to shroud and/or nose cone deployments as well as staging of oval, square and other irregularly shaped bodies.

A flattened bladder 1 may be located between the first and second radax members 2 and 3, and may be coupled to an inflation system 9. The flattened bladder 1 may be positioned such that inflation thereof applies a low-shock separating force to the first and second radax members 2 and 3, thereby separating the first and second members of the radax joint. The low induced shock softens the electronics design requirements for any onboard electronics, and the low complexity design of the illustrated separation system, and class 1.4 pyrotechnic system (discussed further below) improves integration with the rocket bodies and reduces the hazards and handling associated with class 1.1 explosive systems.

One or more members of the radax joint may be configured with a housing for insertion of one or more pyrotechnic piston actuators. Pyrotechnic piston actuator 6 is illustrated in a housing. A retention collar or other fastener such as 4 may serve to hold a pyrotechnic piston actuator in place in the housing. Pyrotechnic piston actuators may be located within or proximal to the radax joint and positioned to increase separation velocity of the first and second radax members upon activation of the one or more pyrotechnic piston actuators. Pyrotechnic piston actuators may for example be employed to supplement the separation force provided by the flattened bladder 1, and to impart additional separation velocity to separated rocket bodies. Such embodiments may enable high-Q stage separation, using pyrotechnic piston actuators that incorporate class 1.4 pyrotechnics. The use of class 1.4 pyrotechnics reduces the hazards and handling associated with class 1.1 explosive systems. High-Q separation capability provides improved separation performance, for the purpose of, for example, early motor separations that occur in the atmosphere and have a risk of re-contacting rocket bodies after separation.

It should be noted that the term "rocket" as used herein refers to any missile, spacecraft, aircraft or other vehicle, whether manned or unmanned, that obtains thrust from a rocket engine. A rocket engine is any engine that ejects propellant mass in a rearward direction in order to produce thrust in a forward direction. Also, the terms rocket and missile are used interchangeably herein.

The term "rocket body" refers to any part of a rocket. In a traditional rocket-based embodiment, a rocket body may for example comprise a rocket stage such as a booster stage or payload stage. Some embodiments of the low-shock rocket body separation technologies described herein may comprise low-shock stage separation systems. However, the potential uses of the described technologies are not limited to rocket stage separation—any number of other rocket bodies may benefit from the low-shock rocket body separation technologies described herein.

Furthermore, the technologies described herein may also be applicable in certain non-rocket applications. In some embodiments, the low-shock rocket body separation technologies described herein may be applied to separation of any first body from any second body, whether the first and second bodies are rocket bodies or otherwise.

Figure 2:
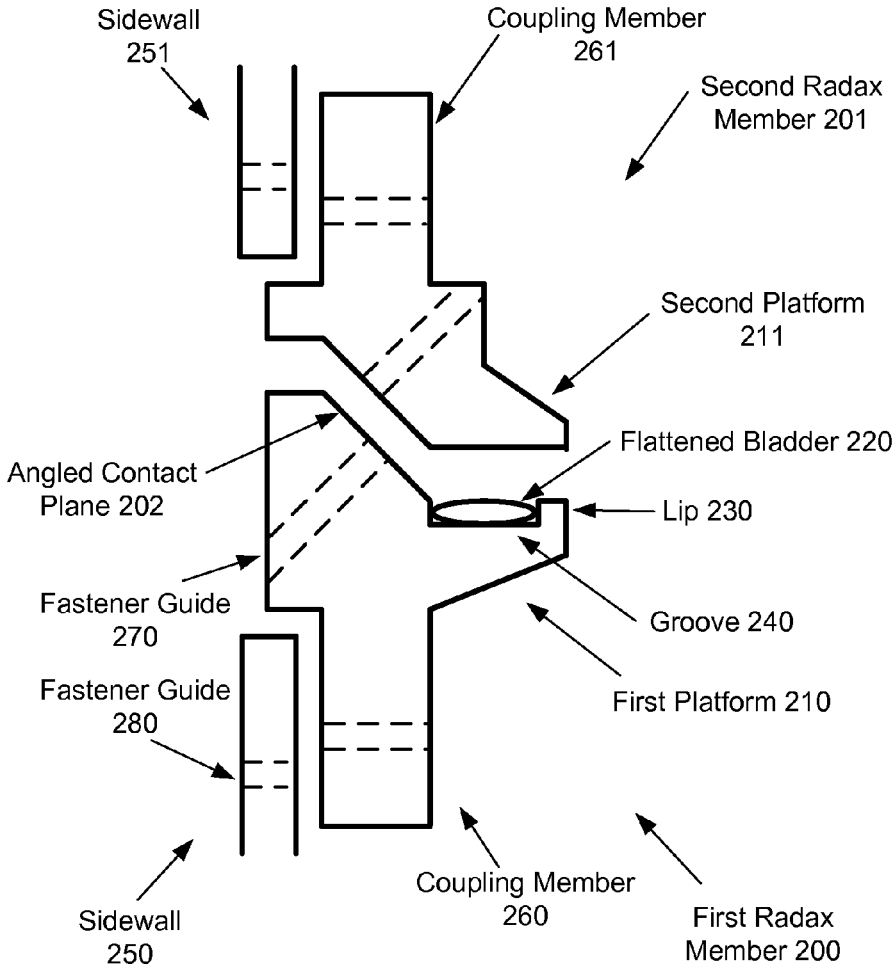
FIG. 2 is a diagram illustrating a cross section of an example rocket body separation system.

FIG. 2 is a diagram illustrating a cross section of an example rocket body separation system. FIG. 2 includes a first radax member 200 and a second radax member 201. The first radax member 200 is coupleable to the second radax member 201 for example by inserting a fastener into fastener guide 270. Fastener guide 270 extends in both the first and second radax members 200 and 201, as illustrated by the dotted lines.

In general, radax joints are characterized in that they comprise an angled contact plane 202 where the male and female radax members make contact, as illustrated, with a fastener that couples the radax members extending through the angled contact plane 202. Radax joints are very strong, stiff and assemble easily, while being low mass. High stiffness provides rocket/missile guidance and control avionics packages desirable system responsiveness and controllability. Building on this flight proven technology, embodiments of this disclosure integrate an innovative flattened bladder design and inflation system, while modifying the radax joint to make it a separable system.

The first radax member 200 is coupleable to a rocket body sidewall 250 for example by inserting a fastener into fastener guide 280, which may extend into the coupling member 260. The coupling member 260 is a portion of the first radax member 200 which may be configured as appropriate for coupling to the sidewall 250. In some embodiments, it will be appreciated that coupling member 260 may be integral to the sidewall 250, whereby the coupling member 260 and sidewall 250 are formed as a single piece, reducing the part count and eliminating a need for a fastener guide and/or fastener. The option of integrating radax members with rocket body sidewalls is an advantage of embodiments of this disclosure. Unlike previous rocket body separations systems, especially those using a Linear Shaped Charge (LSC) for stage separation, the disclosed rocket body separation system does not require an inter-stage. Embodiments without an inter-stage can be lower-weight. Furthermore, the disclosed rocket body separation system does not preclude the use of an inter-stage in some embodiments.

Likewise, the second radax member 201 is coupleable to a rocket body sidewall 251 for example by inserting a fastener into a fastener guide, which may extend into the coupling member 261. The coupling member 261 is a portion of the second radax member 201 which may be configured as appropriate for coupling to the sidewall 251. In some embodiments, it will be appreciated that coupling member 261 may be integral to the sidewall 251, as described with reference to the coupling member 260 and sidewall 250.

Each radax member 200, 201 may further comprise a flange or platform extending therefrom. In FIG. 2, the first radax member 200 comprises first platform 210, and the second radax member 201 comprises second platform 211. The platforms 210, 211 may extend from the radax members 200, 201 such that, when the first and second radax members are coupled together, the first platform 210 on the first radax member 200 is proximal to the second platform 211 on the second radax member 201.

A flattened bladder 220 may be located between the first and second platforms 210, 211, wherein the flattened bladder 220 is positioned such that inflation thereof applies a separating force to the first and second platforms 210, 211, separating the first and second radax members 200, 201 of the radax joint.

In some embodiments, the flattened bladder 220 may be made of a metal such as steel. An example flattened bladder 220 may comprise a plurality of sections of steel tube, welded together, and each section formed in an appropriate shape as desired for a particular radax joint. A flattened bladder 220 may for example have a sidewall thickness between 0.010-0.080 inches. When flattened, a compressed height of the flattened bladder 220 may for example be in the range of 0.050-0.500 inches. A compressed height of 0.150 inches and sidewall thickness of 0.040 inches would leave an example compressed internal volume thickness of 0.070 inches.

In some embodiments, the first and/or second platforms may extend around substantially an entire inner perimeter of the first and/or second radax members. For example referring back to FIG. 1, the platforms may extend around the entire circumference of radax members 2 and 3, with the platforms extending inwardly, e.g. extending into the area that is circumscribed by the radax members. Embodiments in which the platforms extend outwardly may also be adapted for some configurations. Furthermore, in some embodiments, the platforms may extend inwardly in some locations, and outwardly in other locations. Platform placement may be configured as needed to avoid obstacles and accommodate system requirements, while also providing a continuous surface for the flattened bladder 220, such that when the flattened bladder 220 expands, a symmetrical pressure is produced which allows for separation without rotational forces on the separated rocket bodies. Likewise, in some embodiments, the flattened bladder may extend around substantially an entire length of the first and/or second platforms, as illustrated in FIG. 1, in which the flattened bladder 1 extends around the full circumference of radax members 2 and 3.

The flattened bladder 220 may fit in a groove 240 within at least one of the platforms. The groove 240 may be defined by at least one sidewall, e.g., the groove sidewall proximal to the angled contact plane 202. A bottom surface of the groove 240 is illustrated in FIG. 2 within the platform 210. Groove 240 may, but need not, also be defined a sidewall formed by a platform lip 230 on an edge of a platform. Platform lip 230 adds strength to the platform 210, but is not required for rocket body separation. A lip 230 may also prevent debris from getting into the vicinity of the flattened bladder 220 and may serve to prevent malfunctions.

Figure 3A:
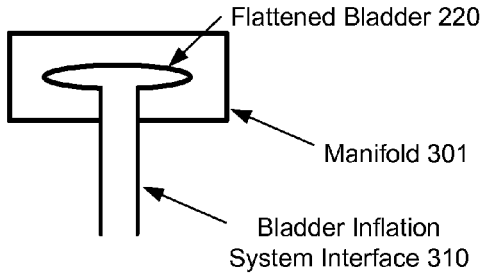
FIG. 3A is a diagram illustrating a cross section of an example flattened bladder, manifold, and bladder inflation system interface.
Figure 3B:
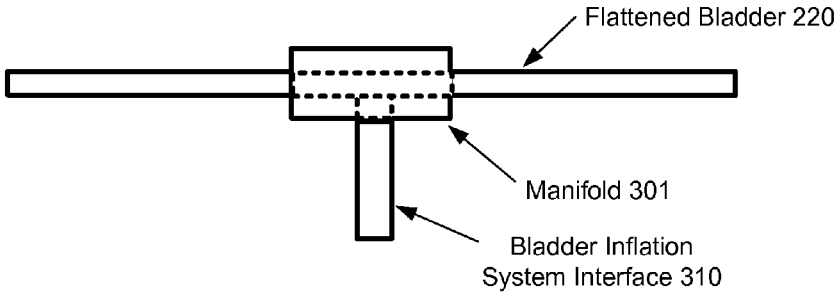
FIG. 3B is a diagram illustrating an example flattened bladder, manifold, and bladder inflation system interface.

FIG. 3A is a diagram illustrating a cross section of an example flattened bladder 220, manifold 301, and bladder inflation system interface 310. FIG. 3B is a diagram illustrating a side view of an example flattened bladder 220, manifold 301, and bladder inflation system interface 310. FIG. 3A and FIG. 3B provide an example of how a rocket body separation system as disclosed herein may be equipped with a bladder inflation system interface 310. The flattened bladder 220 may be configured with a manifold 301 on the bladder 220 at a location defined by the connection between the bladder 220 and the bladder inflation system interface 310.

In some embodiments, a flattened bladder 220 may be equipped with a plurality of bladder inflation system interfaces such as 310. Providing more than one interface such as 310 provides redundancy so that failure of an inflation system does not lead to failure of the separation system as a whole. For example, FIG. 1 illustrates two inflation systems such as 9, connecting to two interfaces such as 310.

Figure 4:
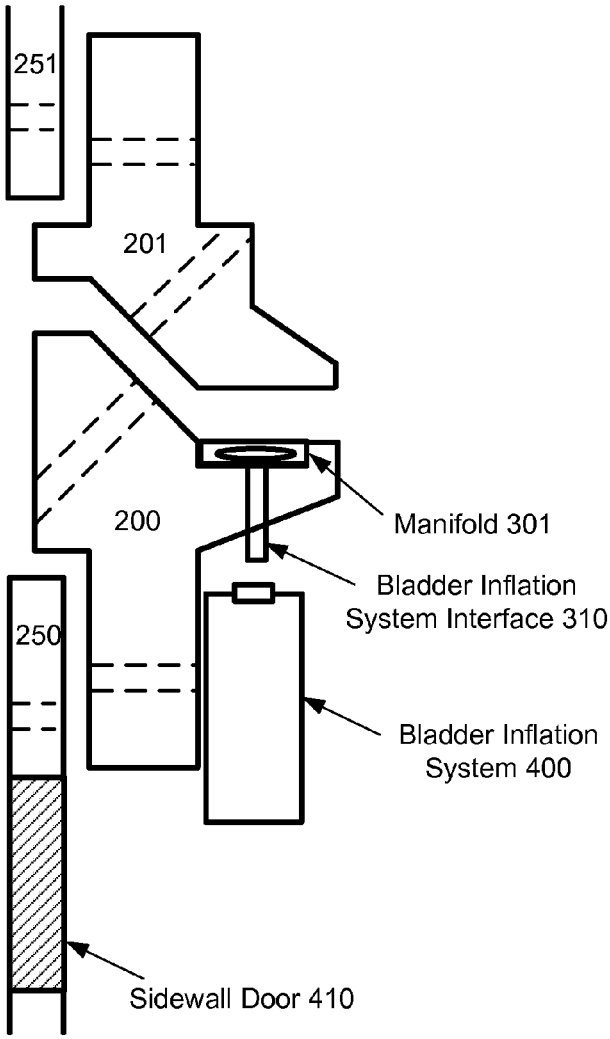
FIG. 4 is a diagram illustrating a cross section of an example rocket body separation system with bladder inflation system.

FIG. 4 is a diagram illustrating a cross section of an example rocket body separation system with bladder inflation system 400. In FIG. 4, the bladder inflation system interface 310 is configured to extend from the manifold 301 in a platform in the radax joint, away from the radax joint to allow attaching a bladder inflation system 400 to the bladder inflation system interface 310 after coupling of the first and second radax members to one another and to their respective rocket stages. In the illustrated example, the bladder inflation system 400 may be accessed via the sidewall door 410, allowing fastening or otherwise coupling of the inflation system 400 to the interface 310.

The bladder inflation system 400 may generally be any system that causes the flattened bladder 220 to inflate. Example systems that may be used as a bladder inflation system 400 are a hot gas generator, which may be electrically initiated and forces hot gas into the flattened bladder 220, and a Rapid Deflagrating Cord (RDC) or mild detonation cord system comprising a cord inside the flattened bladder 220, and an electrically initiated igniter which may access the cord via the inflation system interface 310 to ignite the cord. Either of the above example systems may utilize a class 1.4 pyrotechnic system, which reduces shock via a lower energy explosion than that created by the class 1.1 explosive systems which are commonly used in today's separation systems.

The bladder inflation system interface 310 may be configured to couple with a bladder inflation system 400. For example, when the bladder inflation system 400 is a hot gas generator, the inflation system interface 310 may be a tube of appropriate diameter and sidewall thickness to allow coupling to an output of a hot gas generator, and flow of hot gas from the hot gas generator into the flattened bladder 220 under controlled conditions.

In FIG. 4, the first radax member 200 is a female radax member, and the second radax member 201 is a male radax member. The first radax member 200 is coupleable to a determined rocket body, defined in part by sidewall 250, and the second radax member is coupleable to a subsequent rocket body defined in part by sidewall 251. The "determined" rocket body may be any determined rocket body, e.g. a booster stage such as a first booster stage, second booster stage, etc., a payload stage, or other rocket body. In some embodiments, a determined rocket body may comprise a spent booster stage. The determined rocket body may also be referred to as an aft rocket body.

The subsequent rocket body is any rocket body subsequent to the determined rocket body, for example, if the determined rocket body is a first booster stage, then the subsequent rocket body may be a second booster stage, a payload stage, or other rocket body; if the determined rocket body is a second booster stage, then the subsequent rocket body may be a third booster stage, a payload stage, etc. The subsequent rocket body may also be referred to herein as a forward rocket body.

The flattened bladder has a bladder inflation system interface 310 extending toward the determined rocket body defined in part by sidewall 250, to allow attaching a bladder inflation system 400 within the determined rocket stage. Upon separation of the radax joint, the first radax member 200, the inflation system 400, and the bladder (shown inside manifold 310) are configured to separate from the second radax member 201 and the subsequent rocket body defined in part by sidewall 251.

FIG. 4 may be used to describe a method of assembling a rocket. The rocket may comprise a first radax member 200 coupled to a determined rocket body 250 and a second radax member 201 coupled to a subsequent rocket body 251. Each radax member may comprise a platform extending therefrom such that, when the first and second radax members are coupled together, a first platform on the first radax member is proximal to a second platform on the second radax member, as illustrated in FIG. 4 and also described with reference to FIG. 2. The method of assembling a rocket may comprise: inserting a flattened bladder between the first radax member 200 and second radax member 201, for example by manually positioning the flattened bladder in a platform groove designed to receive the flattened bladder, manifolds and any inflation system interfaces; coupling the first radax member 200 and second radax member 201 together to join the determined rocket body 250 with the subsequent rocket body 251, for example, by inserting fasteners into the fastener guides intersecting the angled contact plane of the radax joint; and after coupling the first radax member 200 and second radax member 201 together, attaching a bladder inflation system 400 to a bladder inflation system interface 310 extending from the flattened bladder (shown inside the manifold 310 in FIG. 4). The bladder inflation system 400 may be attached for example by inserting inflation system 400 through a rocket body sidewall door 410, and welding, screwing, clipping, clamping or otherwise attaching inflation system 400 to interface 310.

An advantage of a method as described above is that it does not require pyrotechnics installation until the final stages of rocket assembly. Pyrotechnics installation may be deferred even to a time after a full up rocket is assembled, for example, if side panels exist on the rocket motor skin as illustrated in FIG. 4. This ability to defer installation of pyrotechnics is referred to as "isolation", and the separation pyrotechnics are an "isolated" system. By isolating the pyrotechnics, assembly and workplace safety can be less hazardous and, as a result, cheaper and less complex.

Figure 5A:
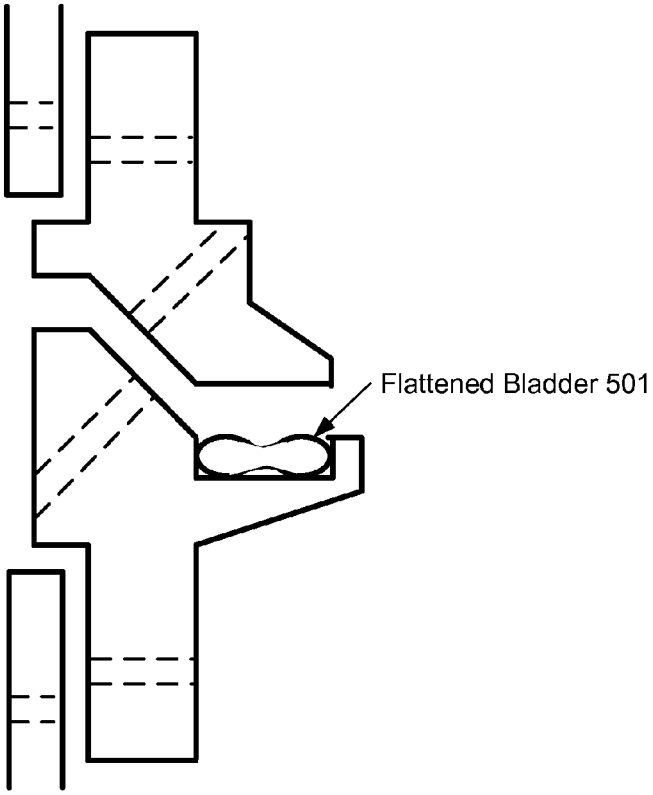
FIG. 5A is a diagram illustrating a cross section of an example rocket body separation system with a shaped flattened bladder.

FIG. 5A is a diagram illustrating a cross section of an example rocket body separation system with a shaped flattened bladder 501. The shaped flattened bladder 501 comprises a flattened middle portion with a compressed height that is less than that of the flattened outer portions, as shown. The illustrated shape has an advantage of not "pinching" the outer portions, which can stress the bladder material (e.g. steel), while also thinning the middle portion to provide enhanced separation force. In some embodiments, a shaped flattened bladder 501 (or a flattened bladder of any shape) may be annealed subsequent to flattening and/or otherwise shaping the flattened bladder.

Figure 5B:
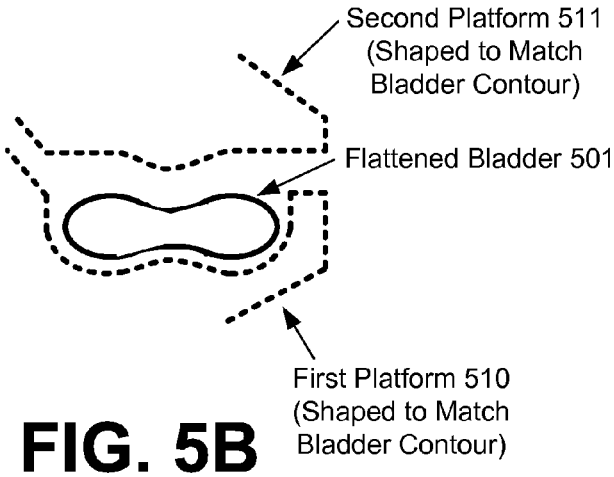
FIG. 5B is a diagram illustrating a cross section of an example rocket body separation system with a shaped flattened bladder and matching shaped platforms.

FIG. 5B is a diagram illustrating a cross section of an example rocket body separation system with a shaped flattened bladder 501 and matching shaped platforms 510 and 511. The shape of the platforms 510 and 511 may fit the shape of the flattened bladder 501, to allow the flattened bladder 501 to impart maximal separation force to the platforms 510 and 511.

Figure 6:
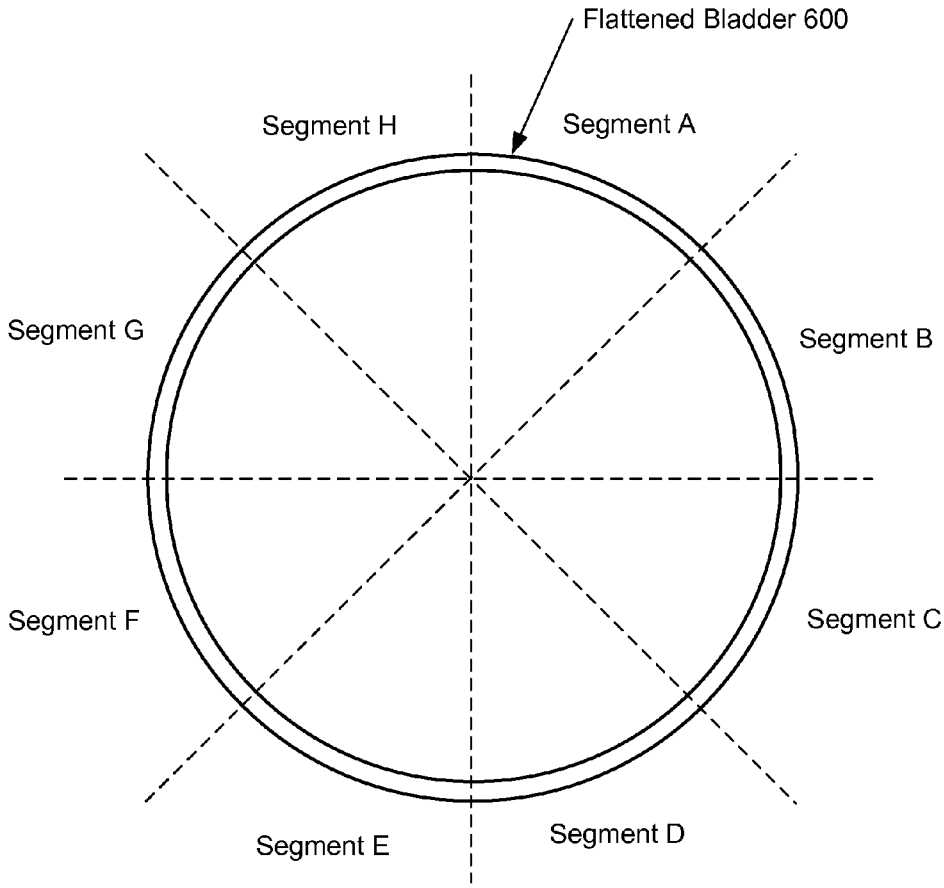
FIG. 6 is a diagram illustrating an example flattened bladder divided into a plurality of segments.

FIG. 6 is a diagram illustrating a top view of a flattened bladder 600. The flattened bladder 600 is dividable into example bladder segments A, B, C, D, E, F, G, and H. In some embodiments, a flattened bladder 600 may be characterized in that it comprises at least one first bladder segment with a compressed height that is thinner (less) than the compressed height of at least one second bladder segment. For example, segments A, C, E, and G may have smaller compressed heights than segments B, D, F, and H. Platform segments may also be shaped to match corresponding segments of the bladder 600. When the bladder 600 inflates, radax joint fasteners near the thinner bladder segments (those of smaller compressed height) may break before fasteners at the thicker (larger compressed height) bladder segments—providing a cascading or multi-stage fastener break. The cascading or multi-stage fastener break may produce lower shock than breaking all of the radax joint fasteners at once.

Figure 7:
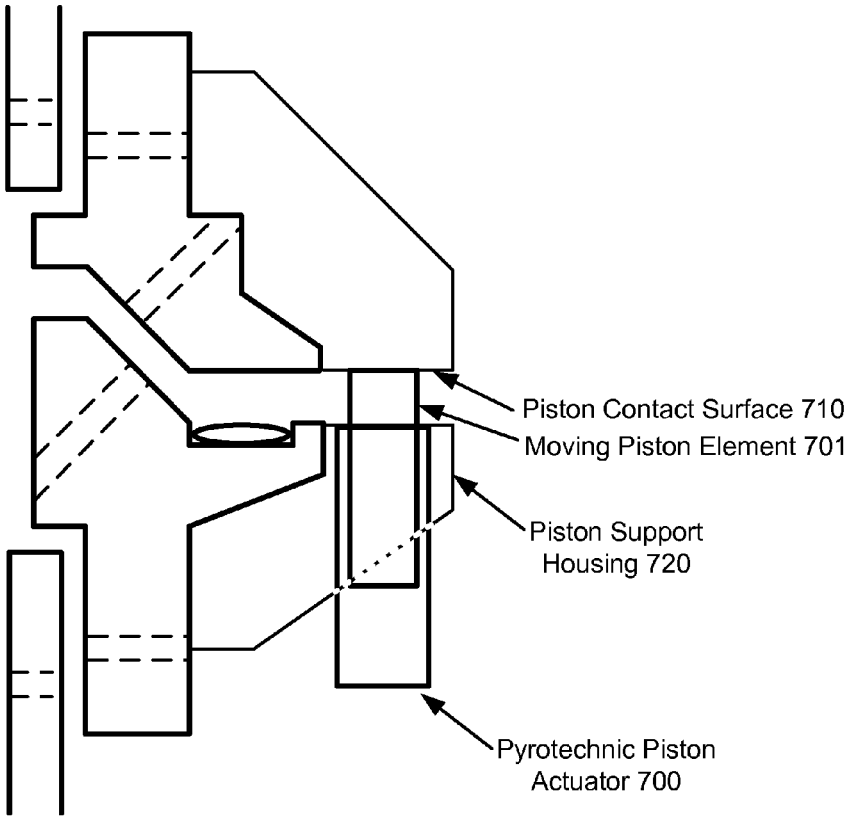
FIG. 7 is a diagram illustrating a cross section of an example rocket body separation system with a pyrotechnic piston actuator.

FIG. 7 is a diagram illustrating a cross section of an example rocket body separation system with a pyrotechnic piston actuator 700. In the illustrated embodiment, the pyrotechnic piston actuator 700 is located within the radax joint by placing the piston actuator 700 in a piston support housing 720, which is attached to one radax member. A moving piston element 701 may make contact with a piston contact surface 710, which is attached to another radax member. Activating the pyrotechnic piston actuator 700 causes the moving piston element 701 to move away from the body of the pyrotechnic piston actuator 700, thereby producing a separating force between the members of the radax joint.

A pyrotechnic piston actuator 700 may be configured to establish prior contact between the moving piston element 701 and the piston contact surface 710, prior to activation of the actuator 700. A variety of mechanisms/configurations may be useful for establishing prior contact, including for example fasteners, springs, air pressure or any number of other approaches as will be appreciated by those of skill in the art, with the benefit of this disclosure. Establishing prior contact reduces shock caused by activating the pyrotechnic piston actuator 700. When the moving piston element 701 is in prior contact with the piston contact surface 710, the moving piston element 701 does not build velocity prior to contacting the piston contact surface 710, and therefore the shock of initially striking the piston contact surface 710 may be avoided.

Figure 8:
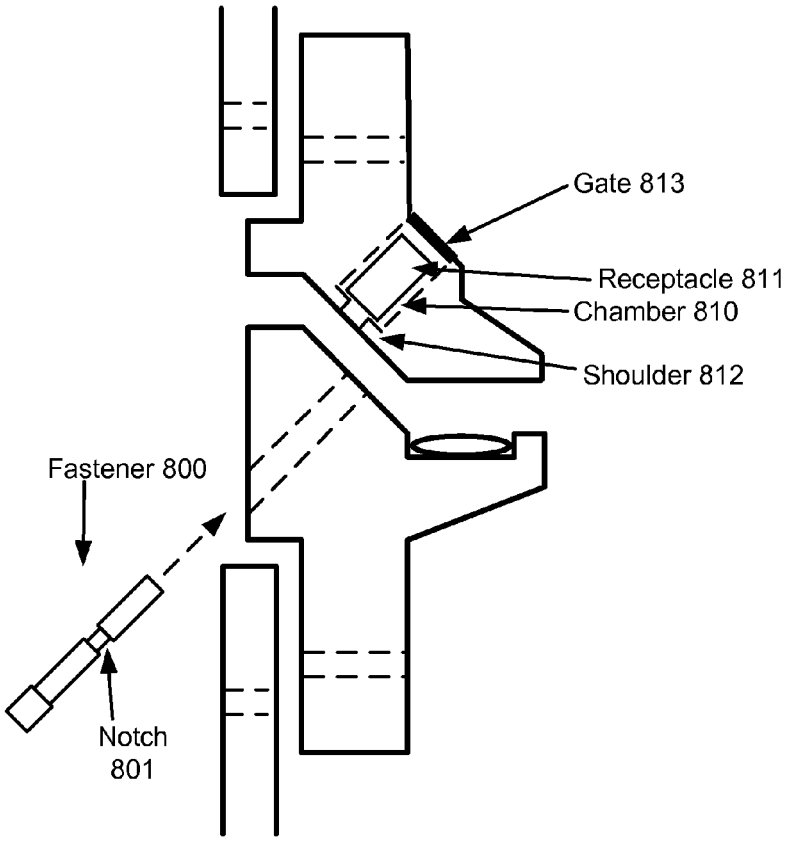
FIG. 8 is a diagram illustrating a cross section of an example rocket body separation system with a notched fastener and floating fastener receptacle.

FIG. 8 is a diagram illustrating a cross section of an example rocket body separation system with a frangible fastener 800 and floating fastener receptacle 811. Either or both of a frangible fastener 800 and floating fastener receptacle 811 may be used to reduce shock caused by separation of the radax joint in some embodiments. While one frangible fastener 800 and one floating fastener receptacle 811 are illustrated in FIG. 8, it will be appreciated that a plurality of frangible fasteners may couple the first and second radax members, and a plurality of floating fastener receptacles 811 may be employed.

In some embodiments, frangible fastener 800 may comprise a frangible bolt with a notch 801 defined by a necked down section that creates a stress concentration at the plane of separation of the radax joint. The fastener 800 and notch 801 may be sized accordingly for a load carrying capability of the joint. The depth and width of the notch 801 may be tailored to allow the fastener 800 to break at a desired load. The fastener 800 may include threaded sections above and below the notch 801, to allow the fastener 800 to attach to each of the radax members. In some embodiments, a frangible fastener 800 may be produced for example by drilling a hole down the length of the fastener 800, or by drilling hole perpendicularly through the fastener 800.

The floating fastener receptacle 811 may be configured to receive a fastener 800 that couples the radax members, while the floating fastener receptacle 811 also allows movement of the fastener 800 (or section of the fastener 800) upon breakage of the fastener 800. Receptacle 811 may for example comprise a threaded nut. When the fastener 800 breaks, the section of the fastener 800 that remains with the radax member having the receptacle 811 can move with respect to the radax member, thereby reducing the shock to the radax member caused by breakage of the fastener 800.

The receptacle 811 may be positioned in a chamber 810 that is wider and/or longer than the diameter and length of the receptacle 811, allowing the receptacle 811 to "float" (move) within the chamber 810. A shoulder 812 allows the fastener 800 to pass through radax member 201 and couple the first and second radax members. The shoulder 812 may be sufficiently sturdy to ensure adequate load-carrying capacity of the radax joint. A gate 813 may open to allow insertion of the receptacle 811, and may close to prevent the receptacle 811 from flying out of the chamber 810 when the fastener 800 breaks, thereby reducing the debris byproducts of separation. Radax member 200 may also be configured with a chamber and gate to retain a free fastener head, further preventing separation debris.

It should be emphasized that frangible fasteners and floating fastener receptacles are not required in all embodiments. For example, some embodiments may employ a threaded insert, e.g., a nut that is threaded on both the outside and inside of the nut, in place of the floating fastener receptacle 811. Unlike the floating fastener receptacle 811, a threaded insert would not be capable of moving with respect to the chamber 800 upon breaking of the fastener 800. Also, some embodiments may be configured according to FIG. 2, with either a threaded fastener guide 270, or a nut that is used to hold an opposite end of a fastener in place.

Figure 9:
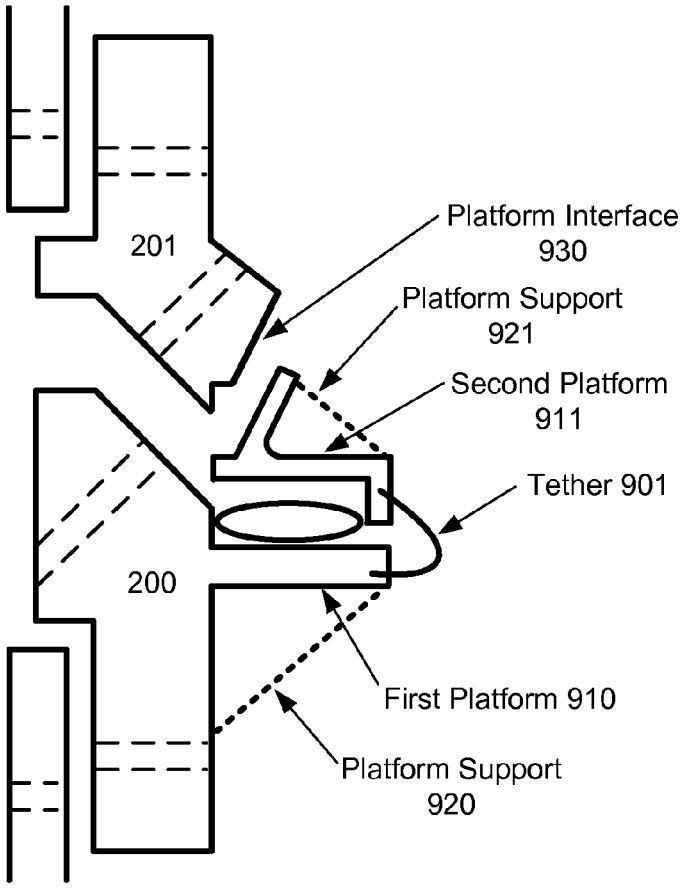
FIG. 9 is a diagram illustrating a cross section of an example rocket body separation system with a detachable platform.

FIG. 9 is a diagram illustrating a cross section of an example rocket body separation system with a detachable platform. FIG. 9 comprises first and second radax members 200 and 201, wherein the second radax member 201 is configured with a platform interface 930 that mates with a detachable second platform 911. The detachable second platform 911 is designed to detach from the radax member 201 after separation of the rocket bodies. A tether 901 may attach the platform 911 to first platform 210, or otherwise to the radax member 200 or a rocket body associated with radax member 200. Upon separation of the rocket bodies, the tether 900 may keep the detachable second platform 911 with the radax member 200 and associated rocket body, reducing debris and reducing the weight of the radax member 201. An additional benefit of detachable platform configurations is clearing of obstructions (such as the detachable platform) for the follow on stage. Clearing obstructions may reduce unwanted plume interactions that may otherwise be produced by such obstructions. In some embodiments, removing obstructions may yield improved performance of various systems, e.g., improved Thrust Vector Control (TVC) maneuvering, and improved operation of an attitude control system.

FIG. 9 illustrates platform supports 920 and 921. Platform supports 920 and 921 may comprise support braces that are spaced some distance apart, supporting the load bearing capacity of the platforms 910 and 911, while providing a reduced platform weight. FIG. 9 also illustrates a lip located on the detachable second platform 911 instead of the first platform 910, which is an alternative configuration as will be appreciated with the benefit of this disclosure.

While certain example techniques have been described and shown herein using various methods, devices and systems, it should be understood by those skilled in the art that various other modifications may be made, and equivalents may be substituted, without departing from claimed subject matter. Additionally, many modifications may be made to adapt a particular situation to the teachings of claimed subject matter without departing from the central concept described herein. Therefore, it is intended that claimed subject matter not be limited to the particular examples disclosed, but that such claimed subject matter also may include all implementations falling within the scope of the appended claims, and equivalents thereof.

The invention claimed is:

1. A rocket body separation system comprising:

a radax joint comprising first and second radax members, each radax member coupleable to a rocket stage, and each radax member coupleable to the other radax member;

each radax member further comprising a platform extending therefrom such that, when the first and second radax members are coupled together, a first platform on the first radax member is proximal to a second platform on the second radax member; and a flattened bladder located between the first and second platforms, wherein the flattened bladder is positioned such that inflation thereof applies a separating force to the first and second platforms, separating the first and second radax members of the radax joint.

2. The rocket body separation system of claim 1, wherein the first and second platforms extend around substantially an entire inner perimeter of the first and second radax members, respectively, and wherein the flattened bladder extends around substantially an entire length of the first and second platforms.

3. The rocket body separation system of claim 1, wherein at least one of the first and second platforms is detachable from the first or second radax member.

4. The rocket body separation system of claim 1, wherein the flattened bladder fits in a groove defined by at least one groove sidewall and a surface of at least one of the platforms.

5. The rocket body separation system of claim 1, wherein the radax joint is round.

6. The rocket body separation system of claim 1, wherein the flattened bladder is configured with a bladder inflation system interface.

7. The rocket body separation system of claim 6, wherein the bladder inflation system interface is configured to extend from the radax joint to allow attaching a bladder inflation system to the bladder inflation system interface after coupling of the first and second radax members to one another and to their respective rocket stages.

8. The rocket body separation system of claim 6, the flattened bladder having a plurality of bladder inflation system interfaces.

9. The rocket body separation system of claim 6, wherein the bladder inflation system interface is configured to couple with a hot gas generator.

10. The rocket body separation system of claim 6, wherein the flattened bladder is configured with a manifold on the bladder at a location defined by the connection between the bladder and the bladder inflation system interface.

11. The rocket body separation system of claim 1, further comprising a Rapid Deflagrating Cord (RDC) or a mild detonation cord inside the flattened bladder.

12. The rocket body separation system of claim 1, wherein the first radax member is a female radax member, and the second radax member is a male radax member, and wherein the first radax member is coupleable to an aft rocket body, and the second radax member is coupleable to a forward rocket body, and wherein the flattened bladder has a bladder inflation system interface extending toward the aft rocket body to allow attaching a bladder inflation system within the aft rocket body, so that, upon separation of the radax joint, the first radax member, the inflation system, and the bladder are configured to separate from the second radax member and the forward rocket body.

13. The rocket body separation system of claim 1, wherein the flattened bladder comprises a flattened middle portion with a compressed height that is less than a compressed height of the flattened outer portions.

14. The rocket body separation system of claim 1, wherein the flattened bladder is characterized in that it comprises at least one first bladder segment with a compressed height less than a compressed height of at least one second bladder segment.

15. The rocket body separation system of claim 1, wherein a sidewall thickness of the flattened bladder is between 0.010-0.080 inches.

16. The rocket body separation system of claim 1, wherein a compressed height of at least one portion of the flattened bladder is 0.050-0.500 inches.

17. The rocket body separation system of claim 1, further comprising one or more pyrotechnic piston actuators located within the radax joint and positioned to increase separation velocity of the first and second radax members upon activation of the one or more pyrotechnic piston actuators.

18. The rocket body separation system of claim 17, wherein the one or more pyrotechnic piston actuators are configured to establish contact between a moving piston element and a piston contact surface prior to activation of the one or more pyrotechnic piston actuators.

19. The rocket body separation system of claim 1, wherein at least one of the radax members comprises a floating fastener receptacle configured to receive a fastener that couples the radax member to the other radax member, and also allows movement of the fastener with respect to the radax member upon breakage of the fastener.

20. The rocket body separation system of claim 1, further comprising a plurality of notched fasteners for coupling the first and second radax members.

21. A method of assembling a rocket, the rocket comprising a first radax member coupled to a determined rocket body and a second radax member coupled to a subsequent rocket stage, each radax member comprising a platform extending therefrom such that, when the first and second radax members are coupled together, a first platform on the first radax member is proximal to a second platform on the second radax member, the method comprising:

inserting a flattened bladder between the first and second radax members;

coupling the first and second radax members together to join the determined rocket body with the subsequent rocket stage; and after coupling the first and second radax members together, attaching a bladder inflation system to a bladder inflation system interface extending from the flattened bladder.

* * * * *